US009178266B2

(12) United States Patent
Burg et al.

(10) Patent No.: US 9,178,266 B2
(45) Date of Patent: Nov. 3, 2015

(54) ANTENNA MODULE FOR VEHICLE

(71) Applicant: Peiker Acustic GmbH & Co. KG, Friedrichsdorf (DE)

(72) Inventors: Ulrich Burg, Offenbach (DE); Jens Lachnitt, Alsfeld (DE)

(73) Assignee: Peiker Acustic GmbH & Co. KG, Friedrichsdorf (DE)

( * ) Notice: Subject to any disclaimer, the term of this patent is extended or adjusted under 35 U.S.C. 154(b) by 319 days.

(21) Appl. No.: 13/663,739

(22) Filed: Oct. 30, 2012

(65) Prior Publication Data

US 2013/0113665 A1 May 9, 2013

(30) Foreign Application Priority Data

Nov. 9, 2011 (DE) ..... 10 2011 117 976
Feb. 16, 2012 (DE) ..... 10 2012 002 953

(51) Int. Cl.
*H01Q 1/12* (2006.01)
*H01Q 1/32* (2006.01)

(52) U.S. Cl.
CPC ..... *H01Q 1/1214* (2013.01); *H01Q 1/3275* (2013.01)

(58) Field of Classification Search
CPC ..... H01Q 1/1214; H01Q 1/27; H01Q 1/32; H01Q 1/325; H01Q 1/3275
USPC ..... 343/711, 713; 439/34, 347
See application file for complete search history.

(56) References Cited

U.S. PATENT DOCUMENTS 5,848,902 A * 12/1998 Yamaguchi et al. ..... 439/34
2004/0212538 A1* 10/2004 Lipka et al. ..... 343/713
2007/0279304 A1* 12/2007 Chakam et al. ..... 343/713
2008/0129620 A1* 6/2008 Zurowski et al. ..... 343/713
2009/0040121 A1 2/2009 Rosenberger et al.
2010/0277379 A1* 11/2010 Lindackers et al. ..... 343/713

FOREIGN PATENT DOCUMENTS

DE 295 00 961 U1 6/1995
DE 44 39 388 C1 2/1996
DE 20 2005 004 658 U1 6/2005
EP 1 863 119 A1 12/2007
WO 2010/036435 A1 4/2010

OTHER PUBLICATIONS

Extended European Search Report dated Feb. 14, 2013.

* cited by examiner

*Primary Examiner* — Robert Karacsony
*Assistant Examiner* — Daniel J Munoz
(74) *Attorney, Agent, or Firm* — Burr & Brown, PLLC

(57) ABSTRACT

The invention relates to an antenna module for a vehicle, wherein an upper assembly comprises a first circuit board, wherein a lower assembly comprises a second circuit board, wherein at least one of the two assemblies is fastened on a vehicle body part of the vehicle, wherein an electrical contact part is arranged on the assembly in each case, wherein the two contact parts respectively comprise at least one antenna contact, and wherein the lower assembly is fixable on the upper assembly. In this case, the second contact part, when the lower assembly is fixed, is displaceable in a plane lying approximately parallel to the vehicle body part from a first position in a displacement direction linearly into a second position, wherein the contact parts are electrically disconnected from one another in the first position and wherein the contact parts are electrically connected in the second position.

15 Claims, 17 Drawing Sheets

4,5
2
1
S1
x'
x
11
22
16
b
6
27
26
33
32
29
31
25
VIa
S2
17
34
21

ANTENNA MODULE FOR VEHICLE

CROSS-REFERENCE TO RELATED APPLICATIONS

This application claims the benefit under 35 USC §119(a)-(d) of German Application No. 10 2011 117 976.7 filed Nov. 9, 2011 and German Application No. 10 2012 002 953.5 filed Feb. 16, 2012, the entireties of which are incorporated herein by reference.

BACKGROUND OF THE INVENTION

1. Field of the Invention

The invention relates to an antenna module for a vehicle, in particular a vehicle roof antenna module.

2. Description of Related Art

A vehicle antenna arrangement is known from DE 295 00 961 U1, which comprises an antenna module, wherein the antenna module comprises an upper assembly having at least one antenna, and a lower assembly, wherein the upper assembly comprises a first circuit board, wherein the lower assembly comprises a second circuit board, wherein at least one of the two assemblies is fastened on a vehicle body part of the vehicle, wherein a first electrical contact part is arranged on the upper assembly, wherein a second electrical contact part is arranged on the lower assembly, wherein the two contact parts respectively comprise at least one antenna contact, wherein the lower assembly is fixable on the upper assembly. Such antenna modules have the disadvantage that there is a significant space requirement for the installation of the lower assembly below the vehicle body part, to be able to guide the lower assembly from below onto the upper assembly perpendicularly to the planar extension of the vehicle body part.

SUMMARY OF THE INVENTION

It is the object of the present invention to propose an antenna module, in which only a small installation space is required below the vehicle body part to join together the two assemblies and in which in particular an internal panel of the vehicle body part, which is located below the upper assembly, does not have to be completely removed for installation or removal. Furthermore, it is an additional object of the present invention to provide an antenna module, whose electrotechnical function is ensured independently of the construction of the vehicle body part.

According to the present invention, the second contact part, when the lower assembly is fixed on the upper assembly, is displaceable in a plane lying approximately parallel to the vehicle body part from a first position linearly into a second position, wherein the first contact part arranged on the upper assembly and the second contact part associated with the lower assembly are electrically disconnected from one another in the first position of the second contact part, and wherein the first contact part and the second contact part are electrically connected or are contacted, respectively, in the second position of the second contact part. Using such an antenna module, it is possible to produce a multicore electrical connection between the upper assembly and the lower assembly, without the lower assembly having to be guided to the upper assembly in the direction of a longitudinal axis of a cutout executed in the vehicle body part. Rather, it is possible to produce the contact through an insertion movement oriented parallel to the planar extension of the vehicle body part and to move the second contact part as in a pocket, which is formed by the vehicle body part and its internal casing—for example, the vehicle body roof plate and the vehicle roof lining. The core of the present invention is therefore an alignment of a contacting movement and a decontacting movement to the planar extension of the vehicle body part. It is thus possible, in particular, to implement a contact without restriction, in which a secure contact is ensured over the entire lifetime of a vehicle.

Furthermore, the present invention provides constructing the lower assembly from a first structural unit and a second structural unit, wherein the second contact part is a component of the second structural unit and wherein the second structural unit is displaceable in relation to the first structural unit. In this way, it is possible to first align the two assemblies to one another and then to displace the second structural unit having the second contact part in relation to the first structural unit, which is fixed on the first assembly.

The present invention also provides equipping the displaceable second structural unit with the second contact part and the lower circuit board and in particular also with a housing, wherein the first structural unit comprises a fastening means in particular, which is fixed on the first assembly in particular, wherein the second structural unit is guided in particular on a guide of the first assembly, and wherein the housing of the second structural unit comprises a counterguide in particular for guiding on the first assembly. Through such a connection of the two assemblies via a guide and a counterguide, more reliable cohesion of the two assemblies and reliable contact of the two contact parts are ensured.

The present invention also provides removably locking the second structural unit with the first structural unit in the second position, wherein the first structural unit is held immovably on the first assembly after the second assembly is placed on the first assembly. The second position, in which the contacts are produced, is thus secured from undesired loosening. However, it is also possible in this way to disconnect the electrical connection between the upper assembly and the lower assembly again, for example, for a service on the antenna module, without having to completely disconnect the upper assembly from the lower assembly immediately for this purpose.

Furthermore, the present invention provides that the second contact part is covered in the first position by a cover lug of the fastening means. In this way, the second contact part is protected from an undesired collision with components of the first assembly during the placement of the second assembly on the first assembly and during the finding of the guide provided by the first assembly.

The present invention also provides forming a recess on the second structural unit and, in particular, on its housing toward the first assembly, through which the first contact part protrudes into an interior of the second structural unit both in the first position and also in the second position of the second structural unit. A displaceability of the second structural unit which is unobstructed by the first contact part is thus ensured.

Furthermore, the present invention provides equipping the fastening means of the first structural unit of the second assembly with a contact surface which is transverse and, in particular, approximately perpendicular to the displacement direction, and which is used as a support surface. In this way, it is possible for a worker in case of service, when the second structural unit is to be retracted from the second position into the first position, to exert a counterforce oriented toward the first structural unit by applying one or more fingers when retracting the second structural unit.

The upper and/or the lower assemblies are equipped with multiple antennas according to the present invention. In this way, it is possible, for example, to equip the upper assembly with antennas for mobile wireless, digital broadcast radio, and analog broadcast radio. Additionally or alternatively, it is provided that the lower assembly is equipped with antennas for at least one radio standard in the near field and with a mobile wireless antenna for emergency call situations.

The present invention also provides implementing the vehicle body part as a vehicle body plate and, in particular, as a vehicle body roof plate. With such an implementation, it is possible to fix the upper assembly using a sheet metal screw for additional securing.

According to the present invention, it is also provided that the first contact part is arranged on the first circuit board and the second contact part is arranged on the second circuit board. Additional lines for connecting the respective circuit board to the respective contact part can thus be omitted.

The present invention also provides equipping the lower assembly with a housing, in relation to which the second contact means is fixed. It is thus possible to displace the second contact means by means of the housing.

According to the present invention, it is provided that the antenna or the antennas, respectively, of the first assembly are arranged outside the vehicle. Optimum reception is ensured in this way.

Furthermore, it is provided that the antennas of the second assembly are arranged inside the vehicle. It is possible in this way to operate them with low transmitting power in the vehicle and to avoid unnecessary power consumption.

According to the present invention, it is provided that the upper assembly is inserted into a cutout of the vehicle body part of the vehicle, wherein the upper assembly comprises a shielding body, by which electrical or electronic parts of the lower assembly are shielded from electrical or electronic parts of the upper assembly. It is advantageous in such an embodiment, in which no section of the vehicle body part of the vehicle lies between the electrical or electronic parts of the upper assembly and the electrical or electronic parts of the lower assembly, that the antenna module can be designed completely optimally according to electrotechnical aspects with respect to the shielding, independently of the construction of the different vehicles. In contrast to known antenna modules, in the design of the antenna module according to the present invention, in which no utilization of a vehicle body part for shielding purposes is provided, it does not have to be considered whether the respective vehicle body part is manufactured from sheet metal or plastic, for example, and in which thickness the vehicle body plate is implemented, for example. Through this embodiment according to the present invention of the antenna module, in which the electrical or electronic parts of the upper assembly and the electrical or electronic parts of the lower assembly lie opposite, free of a vehicle body part, and sufficient shielding is ensured by the antenna module itself, a universally usable antenna module is provided, which is usable independently of a material used for the affected vehicle body part.

A contact part is a multipolar electrical part as defined in the present invention, which is connectable to a further contact part to close a plurality of individual contacts.

An antenna contact as defined in the present invention is to be understood as a contact, via which an antenna signal is transmitted, which is implemented in particular as an HF signal.

BRIEF DESCRIPTION OF THE DRAWINGS

Further details of the present invention are described in the drawing on the basis of schematically illustrated exemplary embodiments.

DETAILED DESCRIPTION OF THE INVENTION

Figure 1:
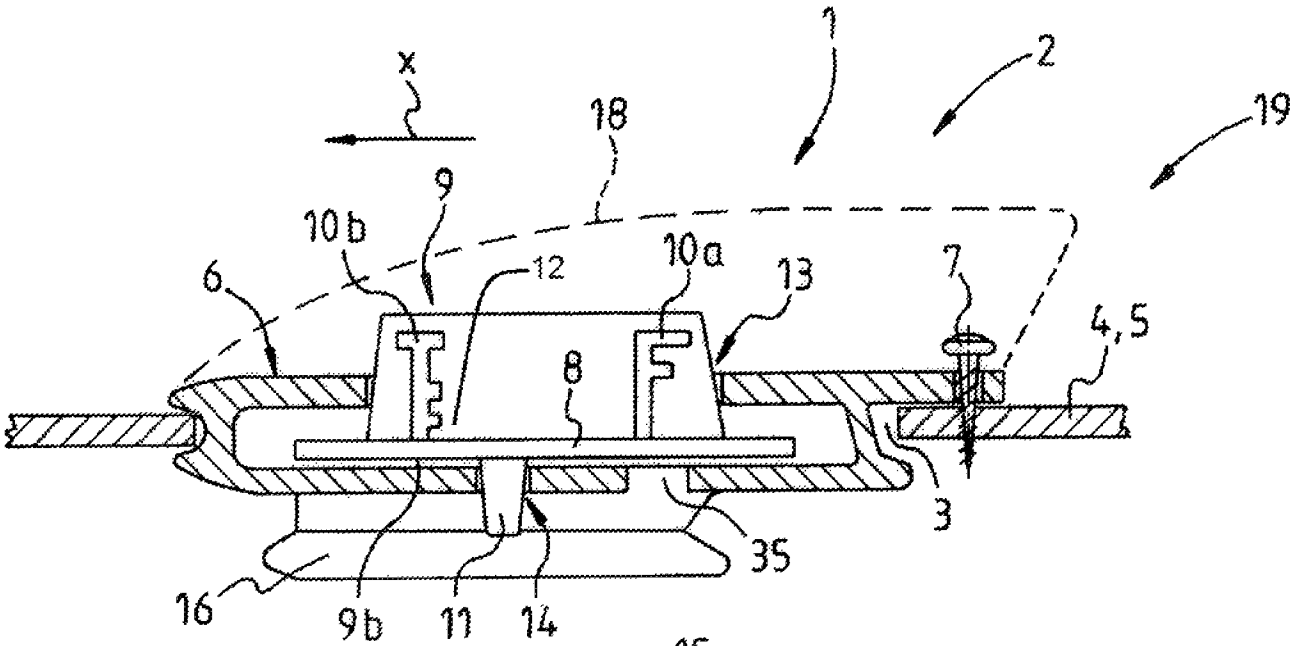
FIG. 1 shows a vehicle body part having a first, upper assembly of a first antenna module according to the present invention inserted therein.

FIG. 1 shows a schematic sectional side view of an upper assembly 1 of an antenna module 2 according to the present invention. The upper assembly 1 is held in a cutout 3 of a vehicle body part 4, which is shown in section, wherein the vehicle body part 4 is implemented as a vehicle body roof plate 5 and a body 6 of the first, upper assembly 1 is additionally fixed using a fastening means 7 on the vehicle body part 4. The first, upper assembly 1 comprises, in addition to the body 6, which forms a housing, a first circuit board 8, a vertically aligned printed circuit board 9 having two antennas 10*a*, 10*b*, and a first, upper contact part 11. The first, upper contact part 11 is implemented as a multipolar contact part and is arranged on a lower side 9*b* of the printed circuit board 9. The body 6 of the first, upper assembly 1 is embodied as a shielding part made of diecast zinc or a material having comparable suitability. The body 6 has a first interior 12, in which the first circuit board 8 is arranged, wherein the printed circuit board 9 extends through an upper slot 13 out of the body 6, and wherein the first, upper contact part 11 extends downward through a lower slot 14 in the direction of a vehicle interior 15. In a lower region, the body 6 is also formed as a guide 16, which is used for coupling the lower assembly 17 shown in FIG. 2 on the first, upper assembly 1. Furthermore, the first, upper assembly 1 comprises a casing 18, which is indicated by dashed lines. This casing is implemented from plastic and ensures good aerodynamics of the antenna module and protects the vertically aligned printed circuit board 9 and the antennas 10*a*, 10*b*, respectively, from weathering influences. A travel direction of a vehicle 19, in which the antenna module 2 is installed, is indicated by an arrow x. According to embodiment variants (not shown), the upper assembly comprises, in addition to a first circuit board 8 and a vertically aligned printed circuit board 9, further printed circuit boards preferably having a total of up to seven antennas, and/or the lower assembly comprises, in addition to the second lower circuit board 21, at least one further circuit board.

Figure 2:
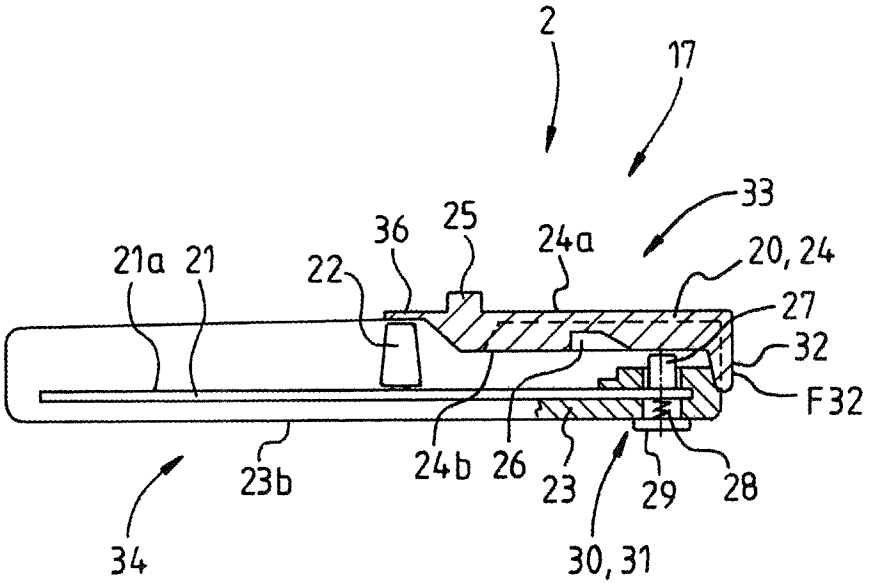
FIG. 2 shows a lower assembly of the first antenna module.

FIG. 2 shows the above-mentioned lower assembly 17 in a schematic, sectional side view. The lower assembly 17 comprises a fastening means 20, a second, lower circuit board 21, a second, lower contact part 22, and a housing 23. The second, lower contact part 22 is fastened on an upper side 21*a* of the second, lower circuit board 21. The fastening means 20 is implemented as a fastening plate 24, which has an upwardly pointing locking lug 25 on an upper side 24*a*. On a lower side 24*b*, the fastening plate 24 has a recess 26. The recess 26 is adapted to a catch pin 27, which is guided in the housing 23 and is pressed by a spring 28 against the lower side 24*b* of the fastening plate. Furthermore, a projection 29, which forms a grip edge 31 with a shoulder 30, is implemented on a lower side 23*b* of the housing 23. A contact surface F32 used as a support surface 32 is implemented laterally on the fastening plate 24. The lower assembly 17 is divided into a first structural unit 33 and a second structural unit 34. The first structural unit 33 comprises the fastening means 20, implemented as a fastening plate 24 in this case. The second structural unit 34 comprises the housing 23, the circuit board 21 received therein, the contact part 22 fixed on the circuit board 21, and the catch pin 27 mounted in the housing 23.

Figure 3:
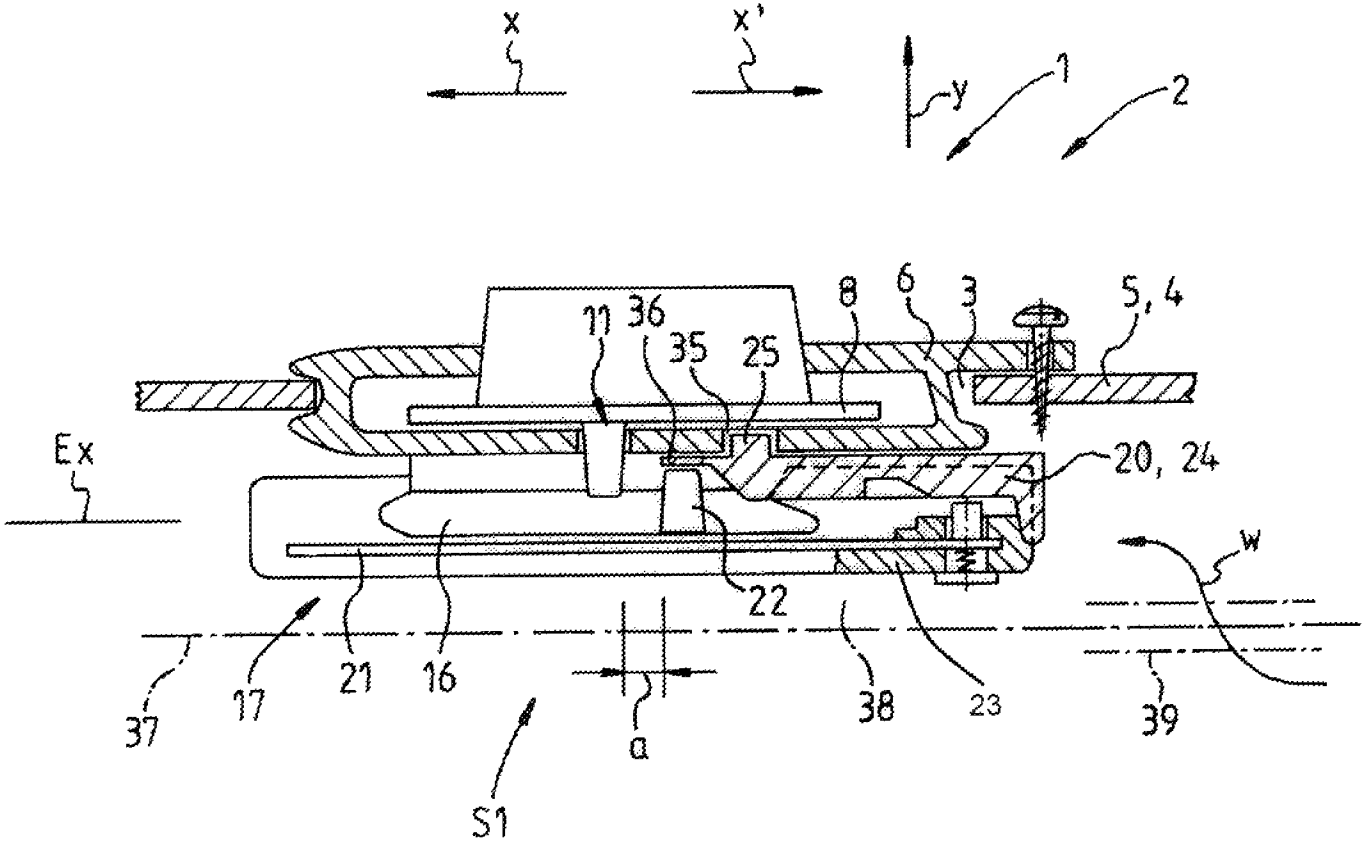
FIG. 3 shows the antenna module, which is formed from the first and the second assemblies, in a first position of the contact parts.

In FIG. 3, the antenna module 2 is now shown with lower assembly 17 fixed on the first, upper assembly 1, wherein the two contact parts, first, upper contact part 11 and second lower contact part 22, (hereinafter contact parts 11 and 22), are in a first position S1, in which they have a distance a to one another and are therefore electrically disconnected from one another. The lower assembly 17 was fixed on the first, upper assembly 1 in its position S1, in that the lower assembly 17 was pushed or placed from below in an arrow direction y and then in an arrow direction x on the guide 16, which is visible in the housing 23, which is shown cut away. In this case, the fixing is fully completed when the lower assembly 17 engages with the locking lug 25 of its fastening means 20 in a setback 35 (see also FIG. 1) on the body 6 of the first, upper assembly 1. A cover lug 36 implemented on the fastening means 20 of the lower assembly 17 (see also FIG. 2) protects the contact part 22 from undesired collisions with the first, upper assembly 1 when the lower assembly 17 is placed on the first, upper assembly 1 in this case. Fundamentally, the lower assembly 17 is pushed on in a plane Ex, which is parallel to a planar extension of the vehicle body part 4. An internal casing 37 associated with the vehicle body part 4 is indicated by dashed lines in FIG. 3, so that it is recognizable how the lower assembly is inserted from the right into a cavity 38 between the vehicle body part 4 and the internal casing 37, without the internal casing 37 having to be disconnected or cut off below the cutout 3 implemented in the vehicle body part 4. Rather, an access opening 39, which is indicated by three parallel dashed lines, is sufficient to insert the lower assembly 17 diagonally from below along an arrow line w into the cavity 38 and to perform a fixing therein of the lower assembly 17 on the first, upper assembly 1, which is already fastened on the vehicle body part 5.

Figures 4A, 4B:
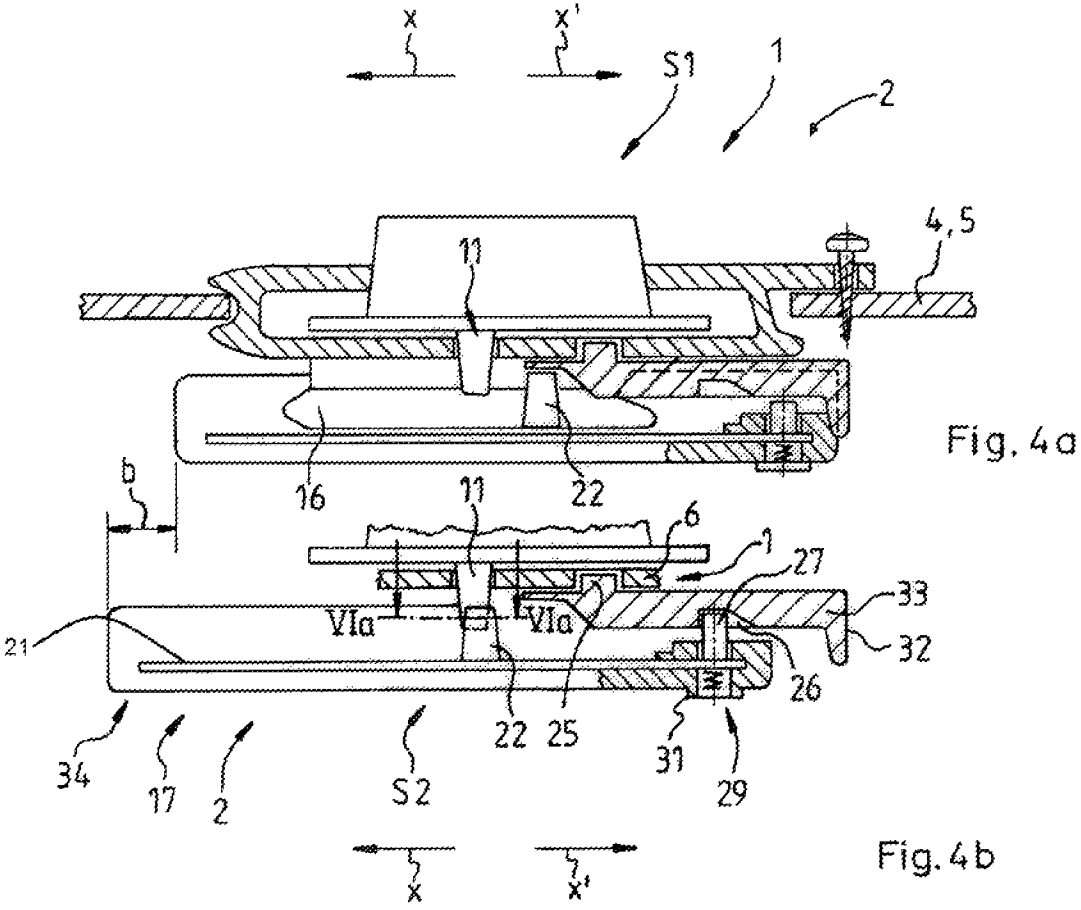
FIG. 4*a* shows another illustration of FIG. 3 for comparison with FIG. 4*b;*
FIG. 4*b* shows a detail from FIG. 4*a*, wherein the contact parts are in a second position.

Upon a comparative consideration of FIGS. 4*a* and 4*b*, which are shown one over the other, it is now recognizable how the two contact parts 11 and 22 are contacted with one another from the position S1. In this case, the illustration of FIG. 4*a* corresponds to the illustration of FIG. 3 and shows the contact parts 11 and 22 in the position S1, which was already described for FIG. 3. To maintain the clarity, the first, upper assembly 1 is still only partially shown in FIG. 4*b*. To contact the contact parts 11 and 22, the second structural unit 34 of the lower assembly 17 is pushed on the guide 16 of the first, upper assembly 1 to the left in the arrow direction x, wherein the first structural unit 33 of the lower assembly 17 remains unchanged in its location with respect to the first, upper assembly 1, since it is blocked against a displacement in the arrow direction x by means of its locking lug 25 on the body 6 of the first, upper assembly 1. From the first position S1 shown in FIG. 4*a*, the second structural unit 34 is therefore displaced by a travel distance b in the arrow direction x to the left into a second position S2. In this second position S2, the contact parts 11 and 22 are then in mechanical and electrical contact with one another. Furthermore, in the second position S2, the catch pin 27 is completely engaged in the recess 26 of the first structural unit 33, so that the second position S2 is secured against undesired loosening due to shocks or acceleration forces. In case of service, during which, for example, a backup battery arranged on the lower circuit board 21 must be replaced, the second structural unit 34 can be retracted by hand or using a corresponding tool from the second position S2 into the first position S1 in the arrow direction x'. For this purpose, it is engaged on the grip edge 31 and on the support surface 32. If needed, after reaching the first position S1, the lower assembly 17 is completely disconnected from the upper assembly 1.

Figure 5:
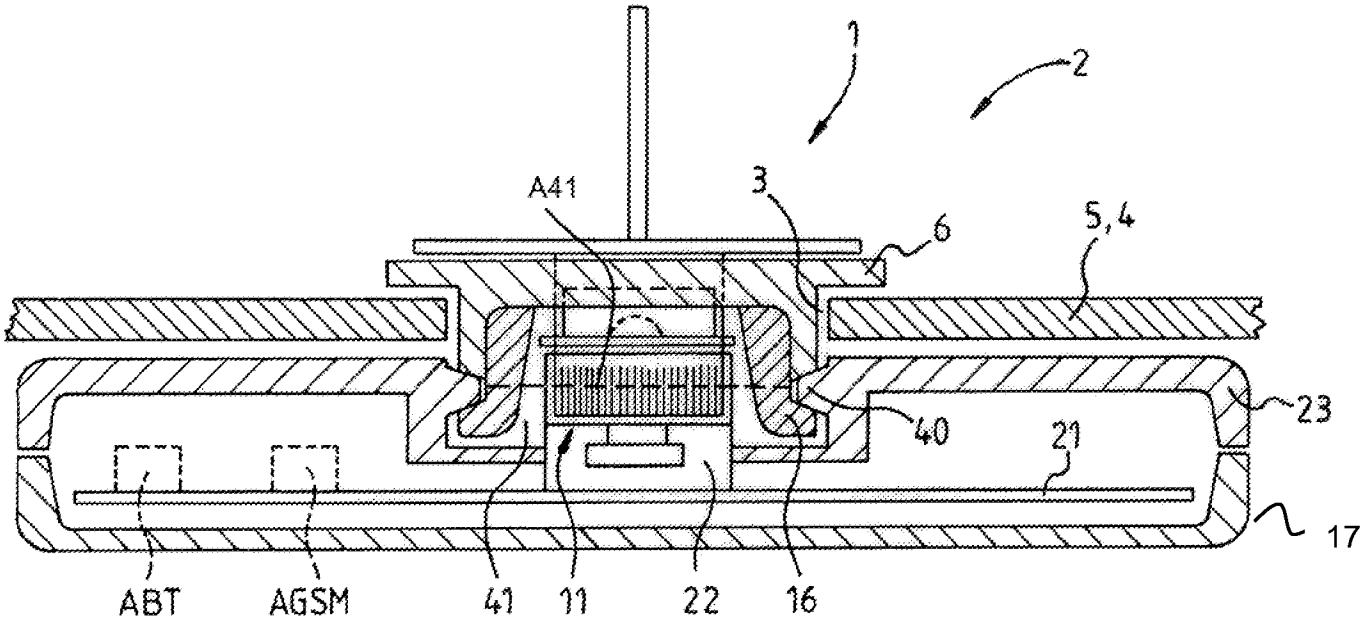
FIG. 5 shows a section through the illustration of FIG. 3.

FIG. 5 schematically shows a section through the first antenna module 2 arrangement shown in FIG. 4*b*. In the view of FIG. 5, it is recognizable how the first, upper assembly 1 is received in the cutout 3 of the vehicle body part 4. The body 6 of the first, upper assembly 1 forms a guide similar to a dovetail below the vehicle body part 4 with the guide 16, to which the two-part housing 23 of the lower assembly 17 forms a counterguide 40 engaging on both sides. The contact part 11 plunges from above through a recess A41 in the second structural unit 34 into an interior 41 of the housing 23 and contacts the contact part 22 therein, which protrudes upward from the second, lower circuit board 21 in the direction of the upper assembly 1. Notwithstanding the preceding illustrations, in FIG. 5, a Bluetooth antenna ABT and a GSM antenna AGSM are schematically indicated, which are arranged on the second, lower circuit board 21.

Figure 6A:
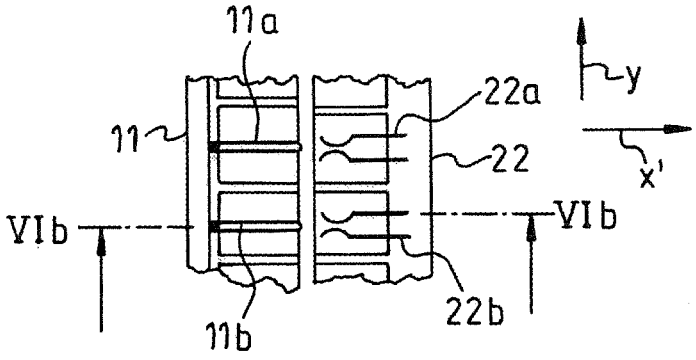
FIG. 6*a* shows a sectional view through the uncontacted opposing contact parts.

FIG. 6*a* shows a section through the contact parts 11 and 22 corresponding to section line VIa-VIa shown in FIG. 4*b*, wherein the two contact parts 11 and 22, in contrast to the illustration of FIG. 4*b*, are not yet in electrical contact and are still slightly spaced apart from one another. The two contact parts 11 and 22 are implemented as multipolar contact parts, which respectively comprise two antenna contacts 11*a*, 11*b* and 22*a*, 22*b*, via which the signals of two outside antennas associated with the first assembly are transmitted when the parts are contacted. The antenna contacts 11*a* and 11*b* are embodied as web-shaped flat contacts in this case. The antenna contacts 22*a* and 22*b* are embodied as so-called fan contacts or flat spring contacts, respectively, as are disclosed and described fundamentally in DE 85 02 106 U1. The two contact parts 11 and 22 each have a plurality of further contacts, which are designed as described and are alternately used for transmitting antenna signals and/or other types of signals and/or for transmitting a feed voltage and/or for grounding the circuit boards.

Figure 6B:
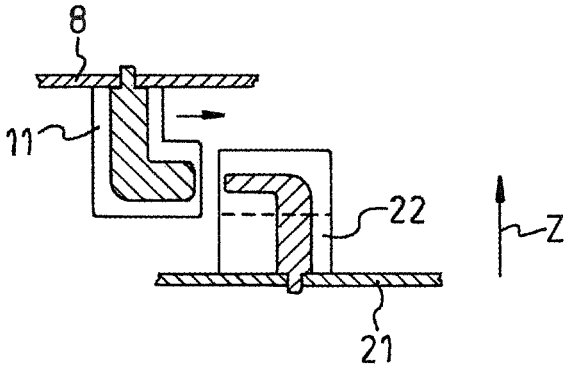
FIG. 6*b* shows a section through FIG. 6*a* along section line VIa-VIa.

FIG. 6*b* shows a section corresponding to section line VIb-VIb shown in FIG. 6*a*, which extends through the antenna contacts 11*b* and 22*b*. The web-shaped implementation of the flat contact 11*b* is clearly recognizable in this view. Furthermore, it is recognizable how the two contact parts 11 and 22 are fixed so they are mechanically loadable on the respective circuit boards 8 or 21. Fundamentally, the two contact parts 11 and 22 are implemented in the formation of the interacting contacts 11*a*, 22*a* or 11*b*, 22*b*, respectively, so that upon the contact, play is present in all three spatial directions x, y, and z, so that a secure contact also occurs if the contact part 22 is slightly tilted or slightly inclined when it is pushed onto the stationary contact part 11.

FIGS. 7 to 10 show a second embodiment variant of a second antenna module 42 according to the present invention in schematic illustrations, wherein comparable parts are identified using the reference signs used for the first embodiment variant.

Figure 7:
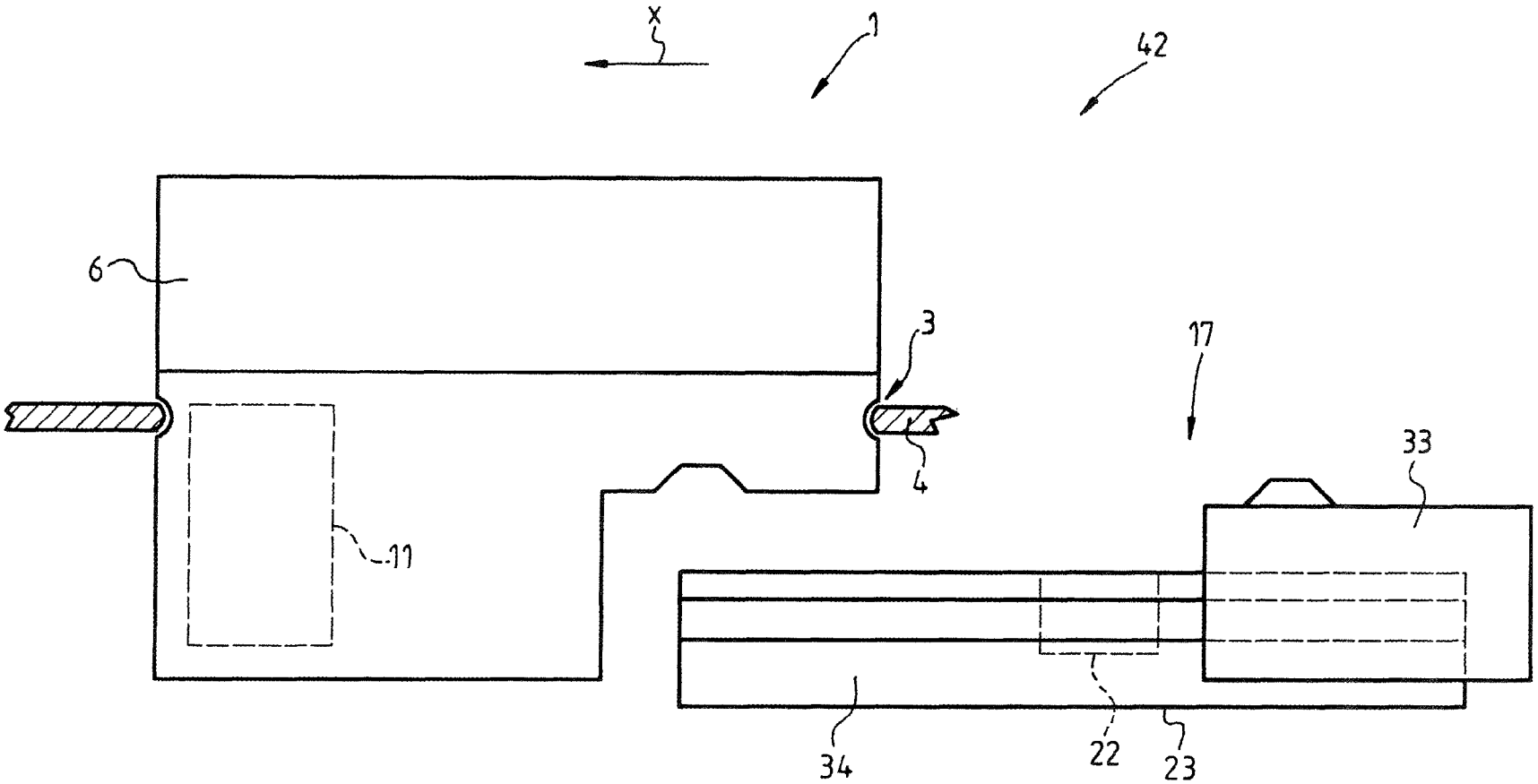
FIG. 7 shows the upper and the lower assemblies of a second antenna module according to the present invention.

FIG. 7 shows a side view of the second antenna module 42 according to the present invention transversely to a travel direction x. A first, upper assembly 1 is already installed in a cutout 3 of a vehicle body part 4 and comprises a contact part 11, shown by dashed lines, which is located in a body 6 of the first, upper assembly 1. A lower assembly 17 is shown laterally adjacent to the upper assembly 1, which is ready to be inserted in the arrow direction x into the upper assembly. The lower assembly 17 comprises a first structural unit 33 and a second structural unit 34. The contact part 22, which is provided for contacting with the contact part 11, which is associated with the first, upper assembly 1, is arranged in a housing 23 of the second structural unit 34 of the lower assembly 17.

Figure 8:
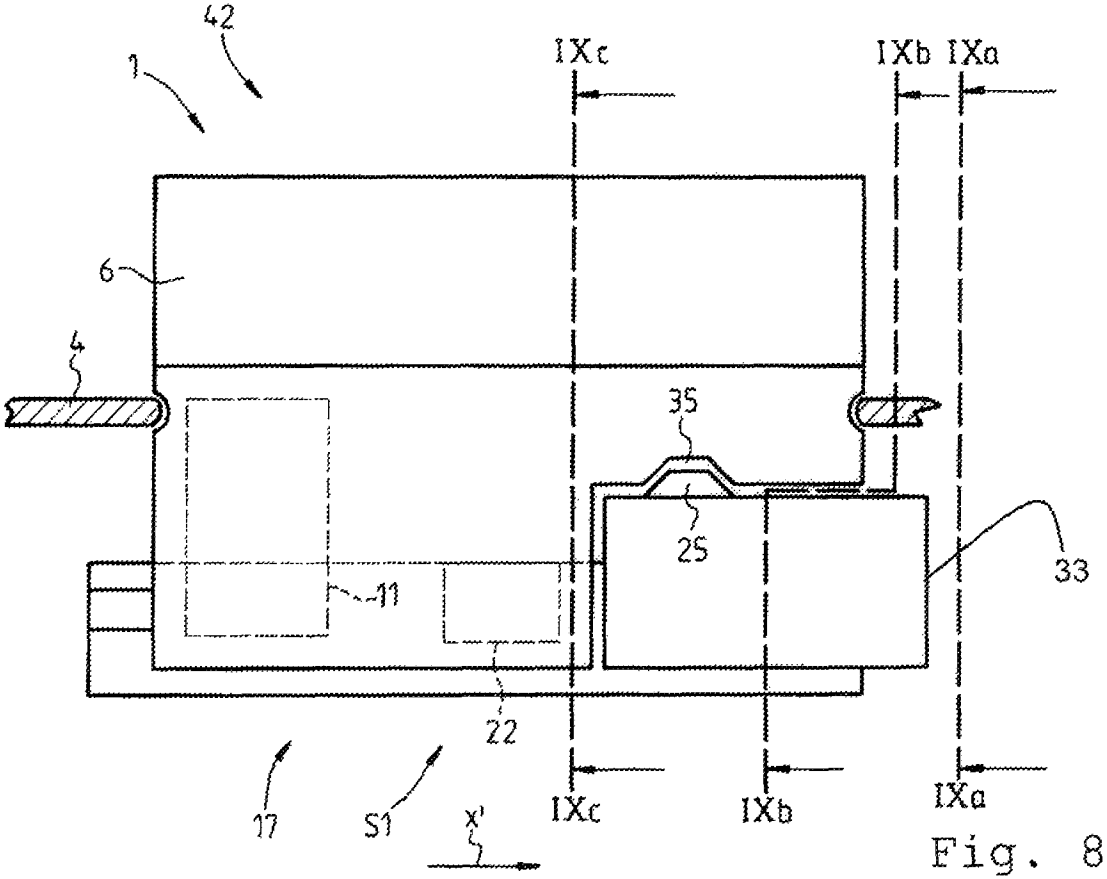
FIG. 8 shows the upper and the lower assemblies of the second antenna module in a first, uncontacted position of the contact parts.

FIG. 8 shows how the two contact parts 11 and 22, when the second assembly 17 is fixed on the first, upper assembly 1, stand in a first position S1, in which they are spaced apart from one another and have no electrical contact to one another. In this first position S1, the first structural unit 33 of the lower assembly 17 is connected via a locking lug 25 in a setback 35 of the body 6.

Figure 9A:
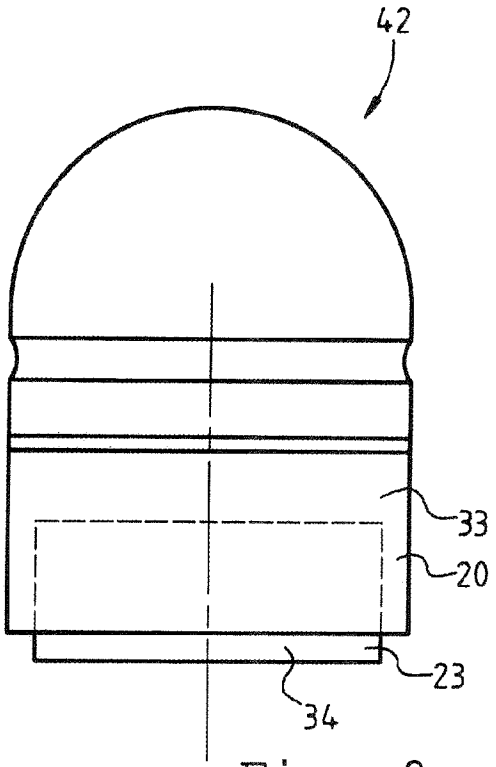
FIGS. 9*a-c* show three sectional views through the illustration of FIG. 8 corresponding to section lines IXa-IXa, IXb-IXb, and IXc-IXc.
Figure 9B:
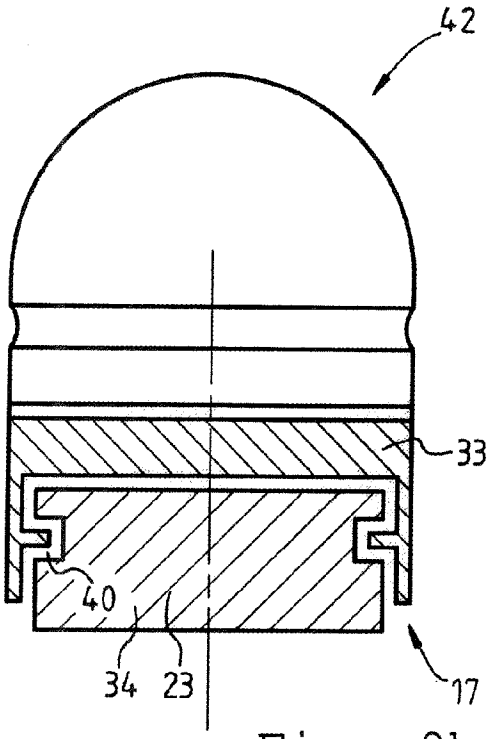
Figure 9C:
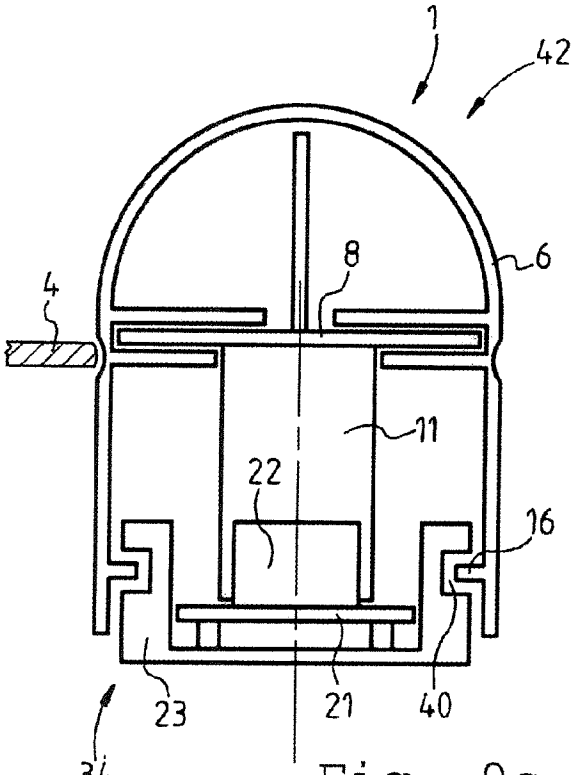

FIGS. 9*a* to 9*c* show three sections through the illustration of FIG. 8 corresponding to section lines IXa-IXa, IXb-IXb, and IXc-IXc. It is recognizable in FIG. 9*a* how the housing 23 of the second structural unit 34 of the lower assembly 17 is covered by a fastening means 20 forming the first structural unit 33, so that the second structural unit 34 cannot be pushed out of the first structural unit 33 in the arrow direction x' (see FIG. 8). It is recognizable in FIG. 9*b* how the first structural unit 33 of the lower assembly 17 is guided on a counterguide 40 of the second structural unit 34 or the housing 23, respectively, so that the first structural unit 33 and the second structural unit 34 are connected to one another. In the sectional illustration of FIG. 9*c*, to maintain the clarity, shading of the sectioned component sections was omitted. It is recognizable in the section how the contact part 22 arranged on a second lower circuit board 21 is opposite to the contact part 11 arranged on a first circuit board 8 and how the second structural unit 34 is composed of the housing 23, the second lower circuit board 21, and the contact part 22, wherein the body 6 forms a guide 16, which interacts with the counterguide 40 formed by the housing 23 and allows a displaceability of the lower structural unit on the upper assembly from the position S1 shown in FIG. 8 into a position S2 shown in FIG. 10.

Figure 10:
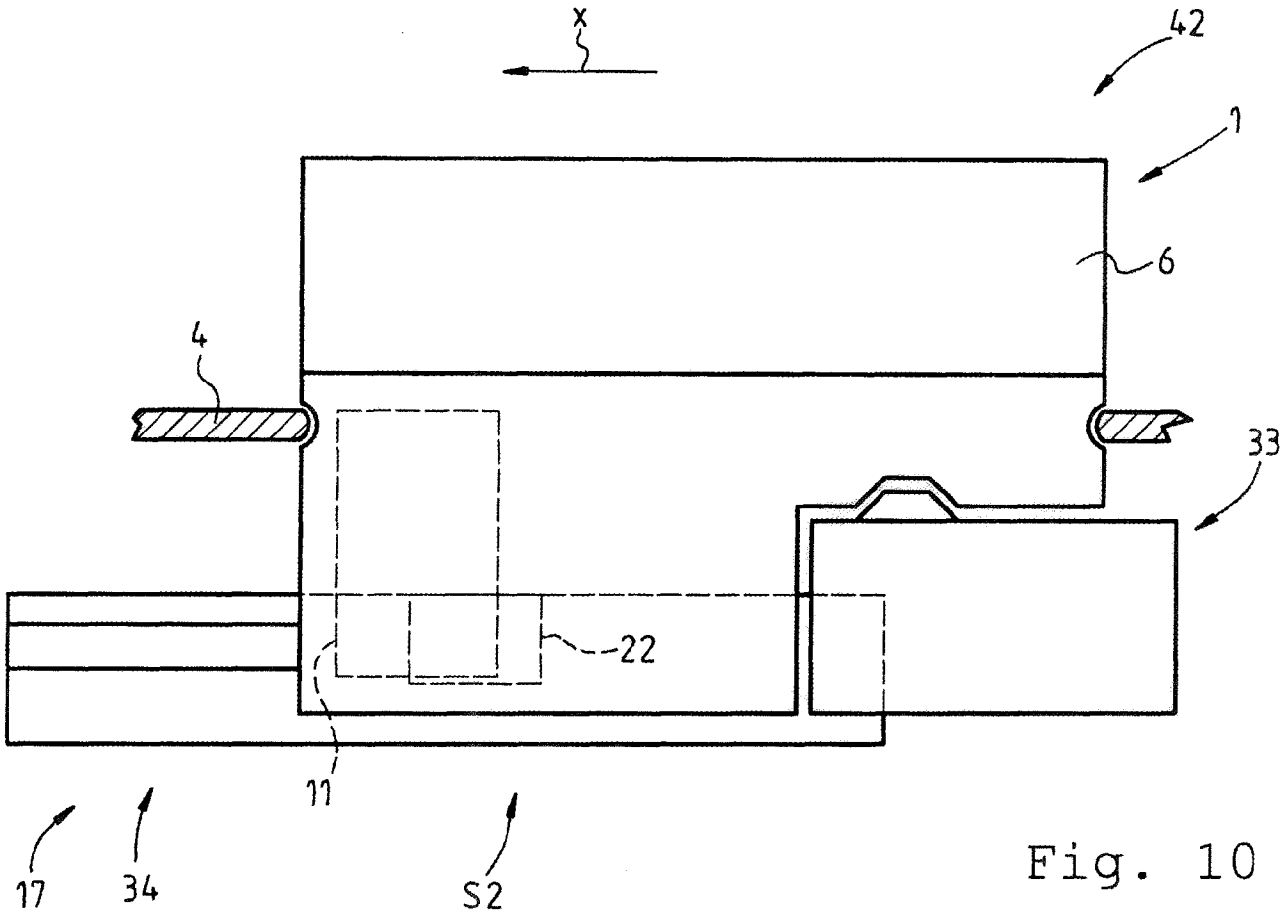
FIG. 10 shows the upper and the lower assemblies of the second antenna module in a second, contacted position of the contact parts.

From a comparative consideration of FIGS. 8 and 10 it may be seen how the position S2 shown in FIG. 10 of the contact parts 11 and 22 results from a displacement of the second structural unit 34 in the arrow direction x, wherein the first structural unit 33 of the lower assembly 17 remains in the position which it also assumes in the case of disconnected contact parts 11 and 22.

In FIGS. 11 to 17, a third embodiment variant of a third antenna module 50 according to the present invention is shown in various views and positions, wherein comparable components are identified using the reference signs used for the first and the second embodiment variants.

Figure 11:
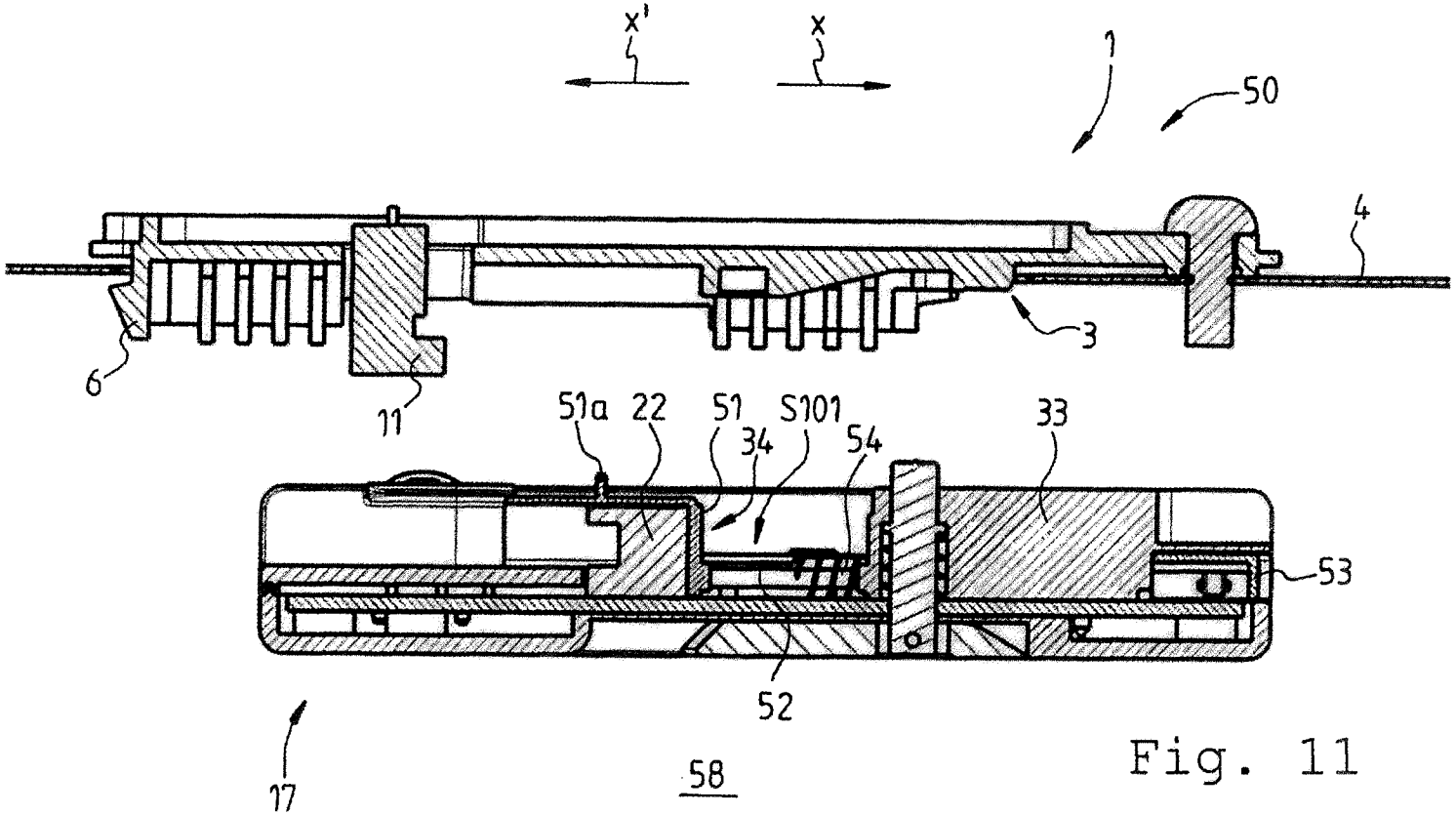
FIGS. 11-17 show a third antenna module according to the present invention in various views and positions.

FIG. 11 shows the third antenna module 50 according to the present invention in a side view transversely to a travel direction x. A first, upper assembly 1 is already installed in a cutout 3 of a vehicle body part 4 and comprises a contact part 11, which is located in a body 6 of the first, upper assembly 1. Below the first, upper assembly 1, a lower assembly 17 is shown, which is ready to be placed on the first, upper assembly 1 and then inserted into the first, upper assembly 1 in an arrow direction x'. The lower assembly 17 comprises a first structural unit 33 and a second structural unit 34, wherein the second structural unit 34 is displaceable in the arrow direction x in relation to the first structural unit 33. The contact part 22, which is provided for the contact with the contact part 11, is connected to the first structural unit 33. The second structural unit 34 comprises a plug protector 51, a thrust transmission means 52, an unlocking slide 53, and a compression spring 54. The plug protector 51 covers the contact part 22 as long as the lower assembly 17 is disconnected from the upper assembly 1 and also as long as it is in the position S1 shown in FIG. 12. The plug protector 51 is connected via the thrust transmission means 52 to the unlocking slide 53. The thrust transmission means 52 is supported via the compression spring 54 on the first structural unit 33 and is pressed by the compression spring 54 into the position S101 shown in FIG. 11.

Figure 12:
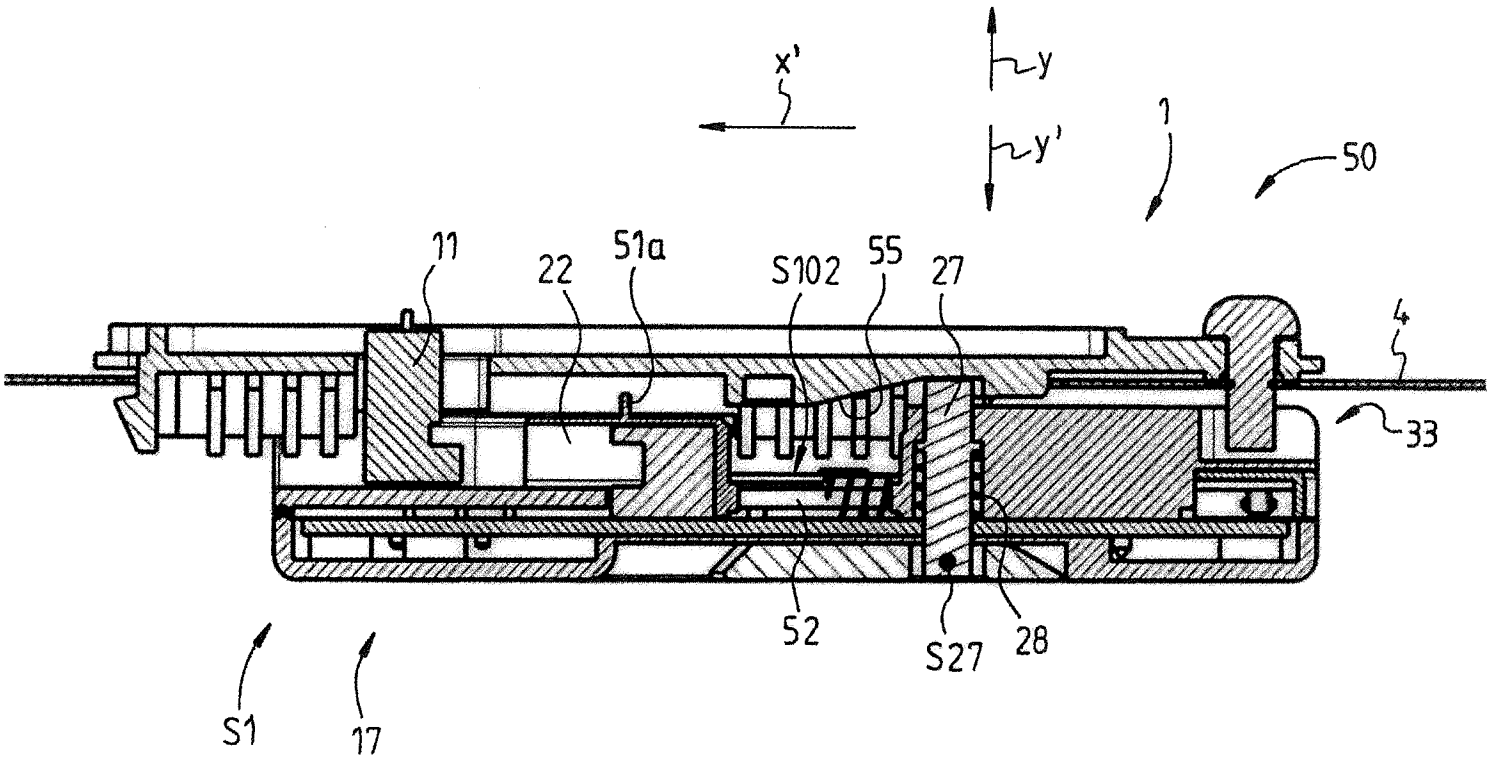
Figure 13:
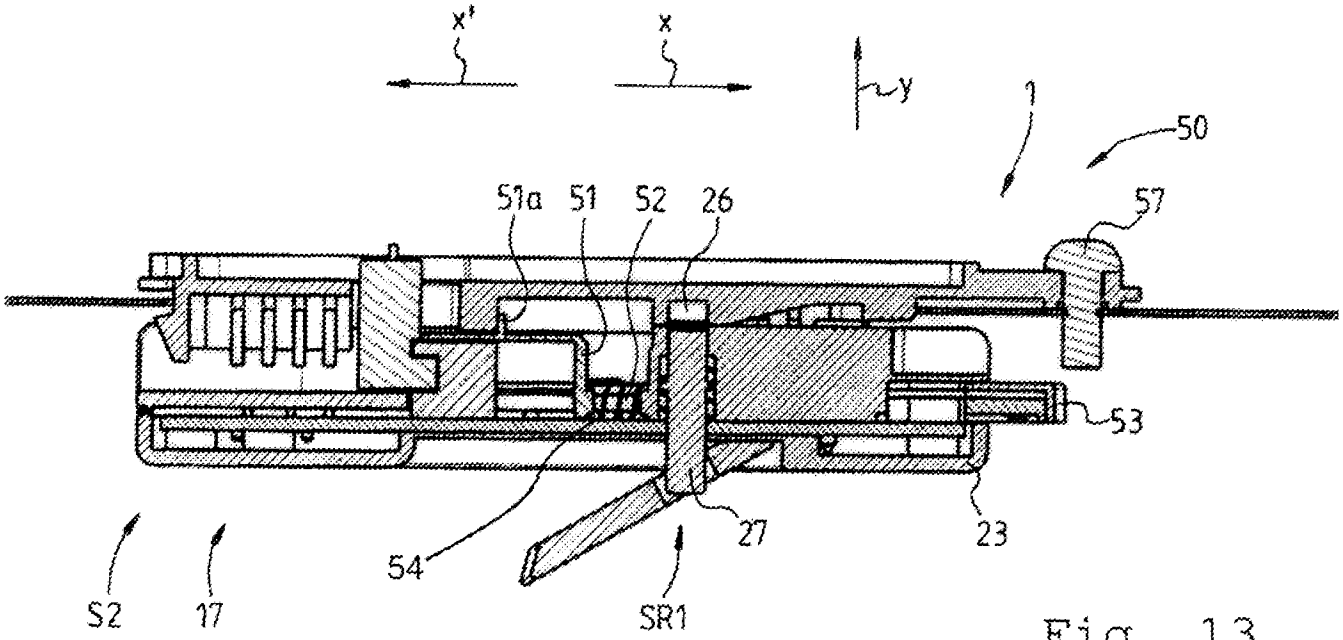

FIG. 12 shows how the lower assembly 17 is placed on the first, upper assembly 1 and displaced slightly into the mentioned first position S1 in the arrow direction x' and therefore pre-fixed or fixed, respectively, on the first, upper assembly 1 via a dovetail guide (not shown). In the first position S1, the two contact parts 11 and 22 are opposite to one another at a distance. Through a displacement of the lower assembly 17 from the position S1 in the arrow direction x' parallel to the extension of the vehicle body part 4 into the position S2 shown in FIG. 13, a catch pin 27, which is supported via a spring 28 on the structural unit 33, is pressed, by an intake bevel 55 implemented on the first, upper assembly 1, against the spring 28 increasingly further in an arrow direction y', so that it is in an open position SR1 shown in FIG. 13 upon reaching the position S2 and subsequently immediately jumps into a recess 26 of the first, upper assembly 1 and assumes a blocking position SR2 shown in FIG. 14. In this blocking position SR2, the catch pin 27 blocks a displacement of the lower assembly 17 on the first, upper assembly 1. The two contact parts 11 and 22 are now in electrical contact in the mentioned position S2. In order to allow this from the position S1, the plug protector 51 runs with a lug 51*a* against the first, upper assembly 1 as the lower assembly 17 is pushed on and is thus stopped before completion of the pushing-on movement. With the plug protector 51, the thrust transmission means 52 and the unlocking slide 53 are also stopped. The compression spring 54 is then pre-tensioned by a further movement of the remaining parts of the lower assembly 17. The thrust transmission means 52 is then in a position S102 to the first structural unit 33.

Figure 14:
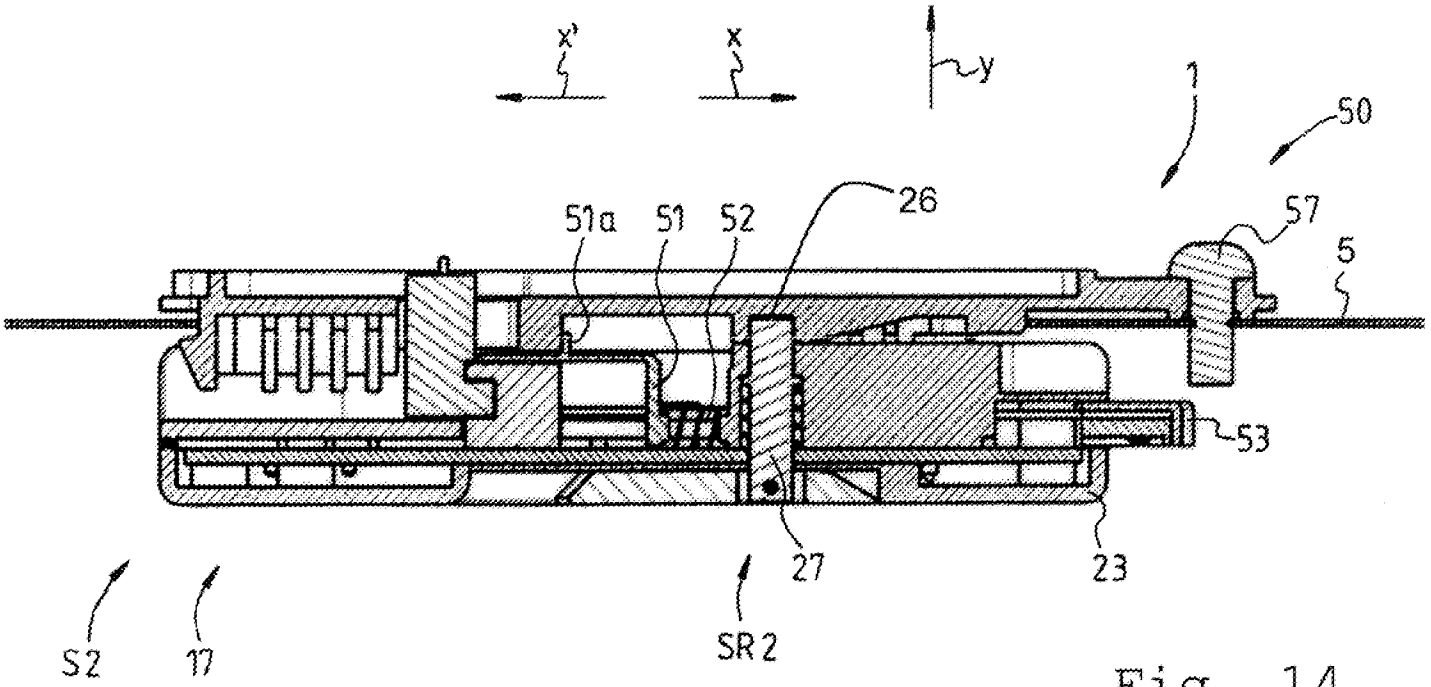

FIG. 14 shows how the two assemblies 1 and 17 are completely connected to one another and locked with one another via the catch pin 27 engaging in the recess 26. In this position S2, the unlocking slide 53 protrudes from housing 23 of the lower assembly 17 in the arrow direction x and, viewed in the arrow direction y, forms a protective cover for a fastening means 57 implemented as a screw, using which the first, upper assembly 1 is screwed together with a vehicle body roof plate 5, which forms the vehicle body part 4. The unlocking slide 53 is implemented as convexly rounded when viewed in the arrow direction y for optimum coverage of the fastening means 57.

Figure 15:
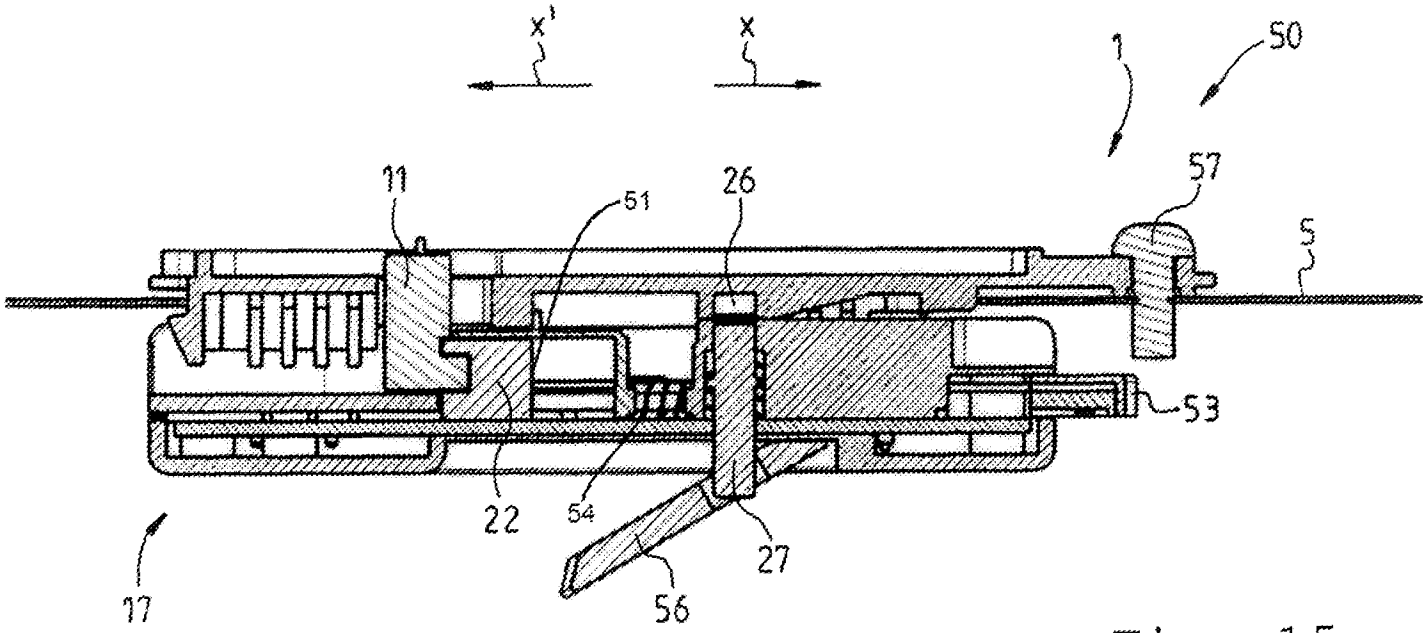
Figure 16:
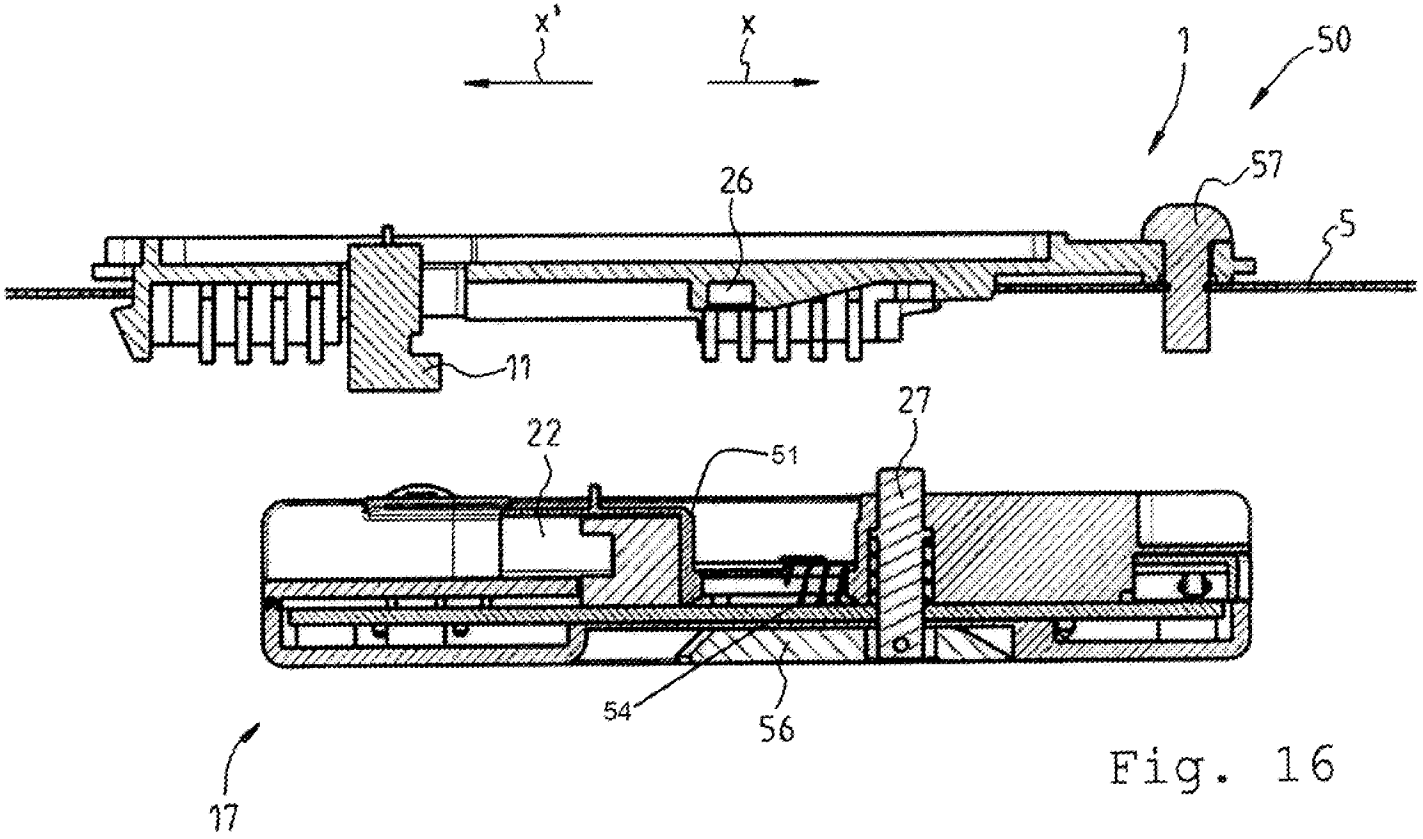

In case of service, the lower assembly 17 is removed from the first, upper assembly 1 in that the catch pin 27 is drawn by means of a toggle 56—as shown in FIG. 15—out of the recess 26 embodied as a borehole and the lower assembly 17 is drawn off of the first, upper assembly 1 in the arrow direction x. This can be executed using one hand by an installer in a simple manner, in that he presses with one finger in the arrow direction x' against the unlocking slide 53 and presses with a further finger of the same hand in an arrow direction x against the toggle 56, in order to move the first structural unit 33 of the lower assembly 17 in the arrow direction x therewith and to disconnect the contact parts 11 and 22 from one another. Via the unlocking slide 53, there is a support on the first, upper assembly 1 and therefore also on a vehicle body roof plate 5, to which the first, upper assembly 1 is connected. The lower assembly 17 can, after reaching the position S1 again, which is shown in FIG. 12, be removed from the upper assembly 1 by a slight further displacement downward in the arrow direction x. The described one-handed unlocking of the lower assembly 17 from the first, upper assembly 1 is only possible in that there is an operational connection via the unlocking slide 53 to the first, upper assembly 1 covered by the lower assembly 17, which allows the lower assembly 17 to be pressed away from the first, upper assembly 1 and the two contact parts 11 and 22 to be disconnected or drawn apart from one another for this purpose. The pressing-down procedure is supported by the compression spring 54, which is pre-tensioned during the pushing-on procedure. This also causes the plug protector 51 to be pushed back over the contact part 22 in a protective manner when the lower assembly 17 is pulled off of the first, upper assembly 1, as shown in FIG. 16, in which the lower assembly 17 is shown completely disconnected from the first, upper assembly 1 again.

Figure 17:
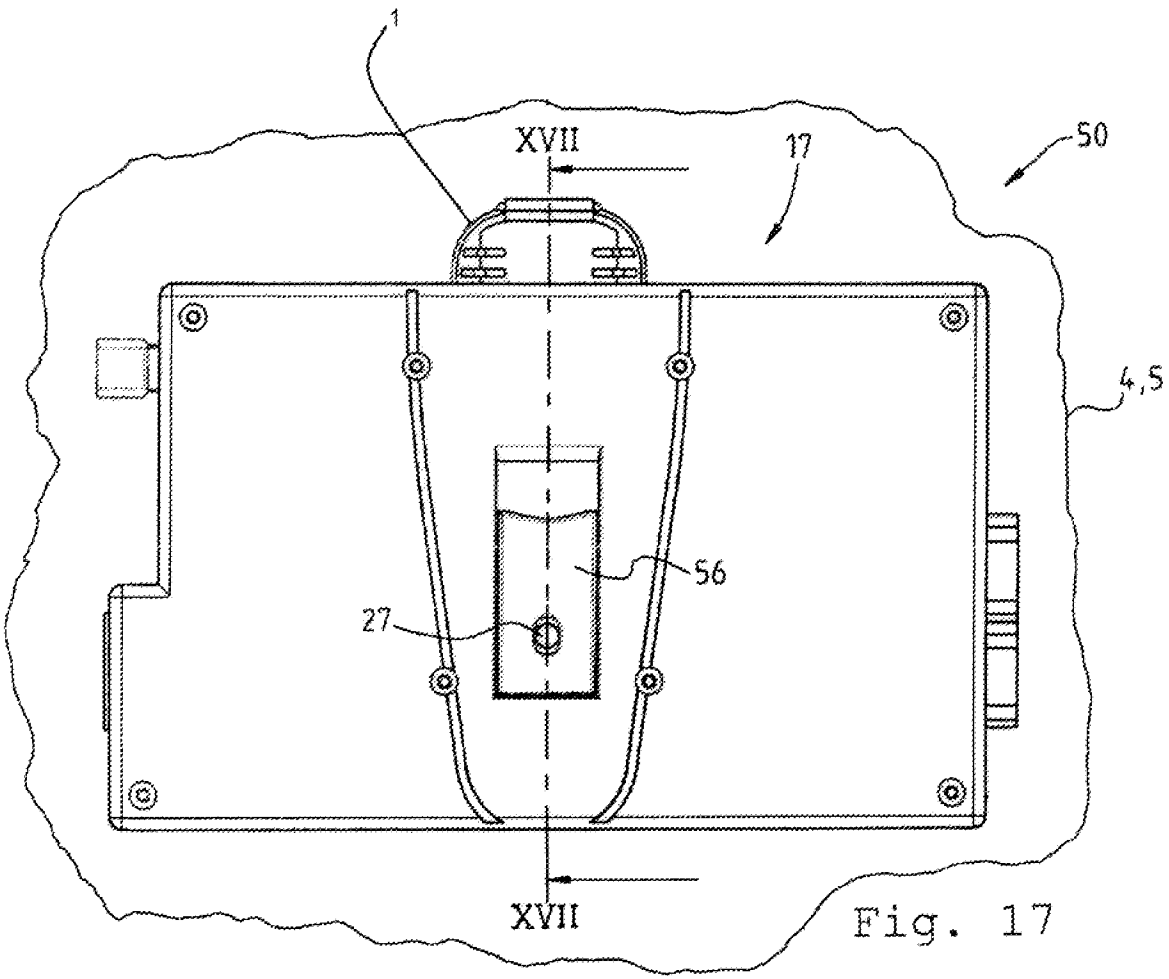

To explain the sectional views shown in FIGS. 11 to 16, a view from a vehicle interior 58—identified in FIG. 11—of the lower assembly 17 aligned for placement on the first, upper assembly 1 is shown in FIG. 17, wherein the sectional views of the lower assembly in FIGS. 11 to 16 are implemented corresponding to section line XVII-XVII indicated in FIG. 17. The vehicle body roof plate 5 is visible behind the lower assembly 17. The toggle 56, using which the catch pin 27 can be disengaged from its locking position, is recognizable in the middle of the lower assembly 17.

The present invention is not restricted to the illustrated or described exemplary embodiments. Rather, it comprises refinements of the present invention in the scope of the intellectual property claims.

LIST OF REFERENCE NUMERALS 1 first, upper assembly
2 first antenna module
3 cutout in 4 or 5
4 vehicle body part
5 vehicle body roof plate
6 body of 1
7 fastening means
8 first circuit board
9 vertical printed circuit board
9*b* lower side of 9
10*a*, 10*b* antenna of 1
11 first, upper contact part
11*a*, 11*b* antenna contact
12 interior of 6
13 upper slot of 6
14 lower slot of 6
15 vehicle interior
16 guide on 6
17 lower assembly
18 casing of 1
19 vehicle
20 fastening means of 17
21 second lower circuit board
21*a* upper side of 21
22 second lower contact part
22*a*, 22*b* antenna contact
23 housing of 17
24 fastening plate
24*a* upper side of 24
24*b* lower side of 24
25 locking lug of 20 or 24
26 recess on 20 or 24
27 catch pin on 23
28 spring for 27
29 projection on 23
30 shoulder of 29
31 grip edge on 29
32 support surface on 20 or 24
33 first structural unit of 17
34 second structural unit of 17
35 setback on 6
36 cover lug
37 internal casing
38 cavity between 4 or 5 and 37
39 access opening to 38
40 counterguide
41 interior of 23
42 second antenna module
50 third antenna module
51 plug protector
51*a* lug on 51
52 thrust transmission means
53 unlocking slide
54 compression spring
55 intake bevel on 1
56 toggle on 27
57 fastening means
58 vehicle interior
a distance between 11 and 33
ABT Bluetooth antenna of 17
AGSM GSM antenna of 17
A41 recess in 34
b distance of 34 between S1 and S2
Ex plane parallel to 4 or 5
F32 contact surface
S1 first position of 11 and 22
S2 second position of 11 and 22
S101 position of 52 in position S1
S102 position of 52 in position S2
SR1 open position of 27
SR2 blocking position of 27
w arrow line
x, x' arrow direction
y, y' arrow direction

We claim:

1. An antenna module for a vehicle comprising:

an upper assembly having a first printed circuit board and at least one antenna; and a lower assembly fixable on the upper assembly and having a second circuit board, wherein at least one of the two assemblies is fastened on a vehicle body part of the vehicle, a first electrical contact part is arranged on the upper assembly, a second electrical contact part is arranged on the lower assembly, and the two contact parts each respectively comprise at least one antenna contact, wherein the second contact part, when the lower assembly is fixed to the upper assembly, is linearly displaceable in a plane lying approximately parallel to the vehicle body part to which the at least one of the two assemblies is fastened from a first position in a displacement direction to a second position, and the two contact parts are electrically disconnected from one another in the first position, and the two contact parts are electrically connected to each other in the second position, and wherein the first electrical contact part is arranged on the first printed circuit board, and wherein the second electrical contact part is arranged on the second circuit board.

2. The antenna module according to claim 1, wherein the lower assembly comprises a first structural unit and a second structural unit, wherein the second structural unit comprises the second contact part and is displaceable in relation to the first structural unit.

3. The antenna module according to claim 2, wherein the second structural unit comprises the second contact part and the second circuit board, wherein the first structural unit comprises a fastening mechanism fixed on an upper surface of the lower assembly, and wherein the second structural unit is guided on a guide of the upper assembly.

4. The antenna module according to claim 3, wherein the second structural unit comprises a housing having a counter-guide.

5. The antenna module according to claim 2, wherein the second structural unit is removably locked with the first structural unit in the second position, and wherein the first structural unit is held immovably on the upper assembly.

6. The antenna module according to claim 1, wherein the second electrical contact part is protected in the first position by a cover lug of the fastening means.

7. The antenna module according to claim 2, wherein the second structural unit has a recess toward the first assembly, through which the first electrical contact part protrudes into an interior of the second structural unit both in the first position and also in the second position of the second structural unit.

8. The antenna module according to claim 3, wherein the fastening mechanism has a contact surface, which is transverse and approximately perpendicular to the displacement direction, that is used as a support surface.

9. The antenna module according to claim 1, wherein at least one of the upper assembly and lower assembly comprises multiple antennas.

10. The antenna module according to claim 1, wherein the vehicle body part is a vehicle body roof plate.

11. The antenna module according to claim 1, wherein the lower assembly comprises a housing, to which the second contact part is fixed.

12. The antenna module according to claim 1, wherein the antenna of the upper assembly is arranged outside the vehicle.

13. The antenna module according to claim 1, wherein the antenna of the lower assembly is arranged inside the vehicle.

14. The antenna module according to claim 1, wherein the upper assembly is inserted into a cutout of the vehicle body part, and wherein the upper assembly comprises a shielding body that shields electrical or electronic parts of the lower assembly from electrical or electronic parts of the upper assembly.

15. The antenna module according to claim 13, wherein the shielding body is one of a diecast zinc housing and an aluminum alloy housing, and the cutout of the vehicle body part is a roof cutout.

* * * * *